US007540059B2

(12) United States Patent
Wright, Sr.

(10) Patent No.: US 7,540,059 B2
(45) Date of Patent: Jun. 2, 2009

(54) METHOD AND APPARATUS FOR STOP LOG SLOT/GUIDE SEALING SURFACE CLEANING

(76) Inventor: Bradley Russell Wright, Sr., 6020 Constitution Dr., Saint Leonard, MD (US) 20678

( * ) Notice: Subject to any disclaimer, the term of this patent is extended or adjusted under 35 U.S.C. 154(b) by 467 days.

(21) Appl. No.: 11/154,856

(22) Filed: Jun. 17, 2005

(65) Prior Publication Data

US 2005/0278886 A1 Dec. 22, 2005

Related U.S. Application Data

(60) Provisional application No. 60/581,332, filed on Jun. 18, 2004.

(51) Int. Cl.
*A47L 1/00* (2006.01)

(52) U.S. Cl. ..... 15/246

(58) Field of Classification Search ..... 15/246
See application file for complete search history.

(56) References Cited

FOREIGN PATENT DOCUMENTS

JP 06065920 * 3/1994

OTHER PUBLICATIONS

Machine translation of JP06065920.*

* cited by examiner

*Primary Examiner*—Frankie L Stinson
*Assistant Examiner*—Samuel A Waldbaum
(74) *Attorney, Agent, or Firm*—John T. Whelan

(57) ABSTRACT

A stop log slot/guide cleaning method and apparatus is disclosed as a frame with attached scraping or scrubbing devices attached in locations that will contact and shear off attached marine life or debris. A flushing system that using water or compressed air or both attached and located on the frame pushes the removed or loose debris off of the stop log slot/guide seating surfaces as the frame is lowered into or removed from the slot leaving clean flat sealing surfaces for the stop log seals to seal against.

9 Claims, 20 Drawing Sheets

Figure 1 Stop Log Slot Cleaning Machine
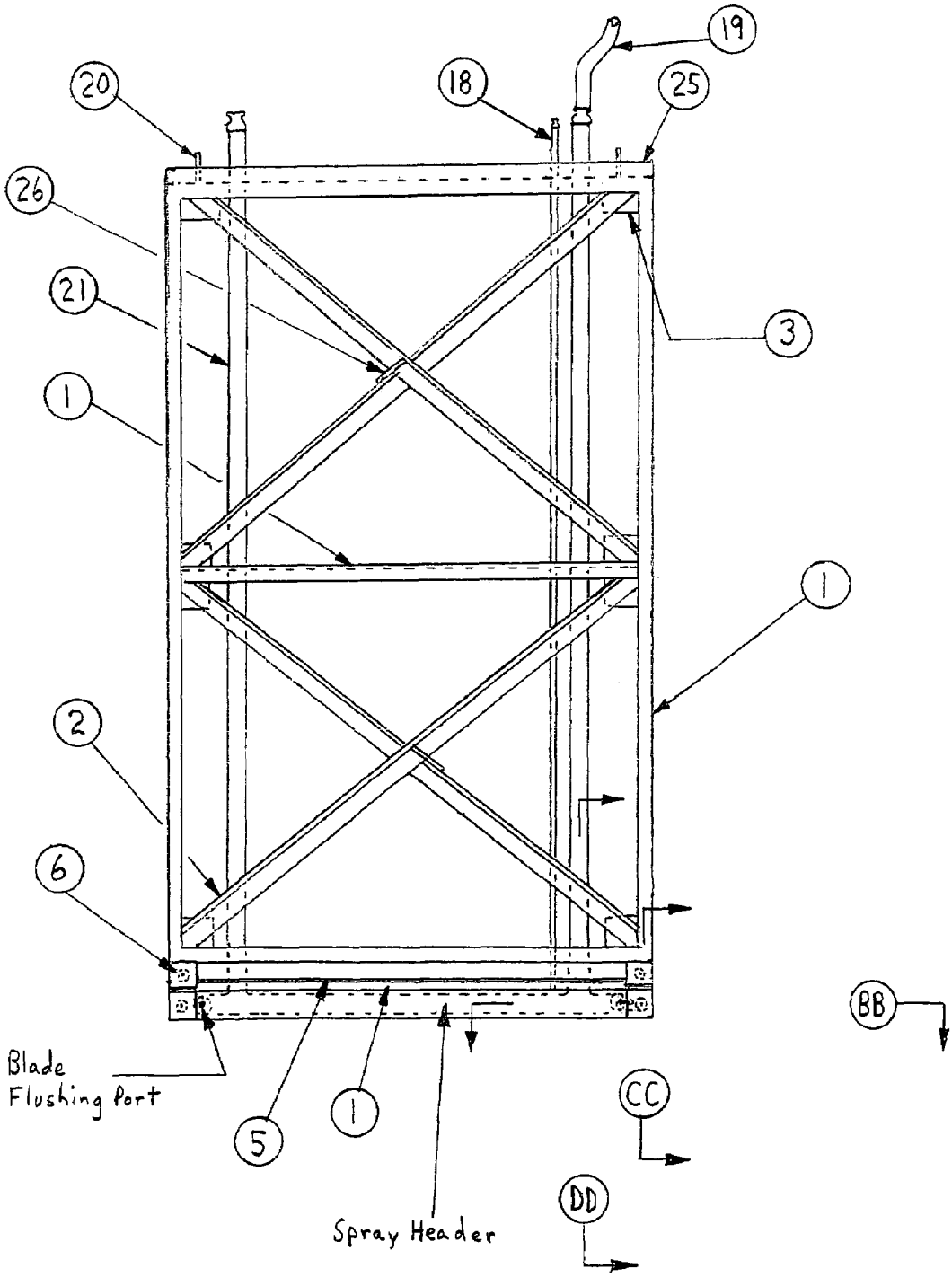

Figure 2 Section View BB Stop Log Slot Cleaning Machine
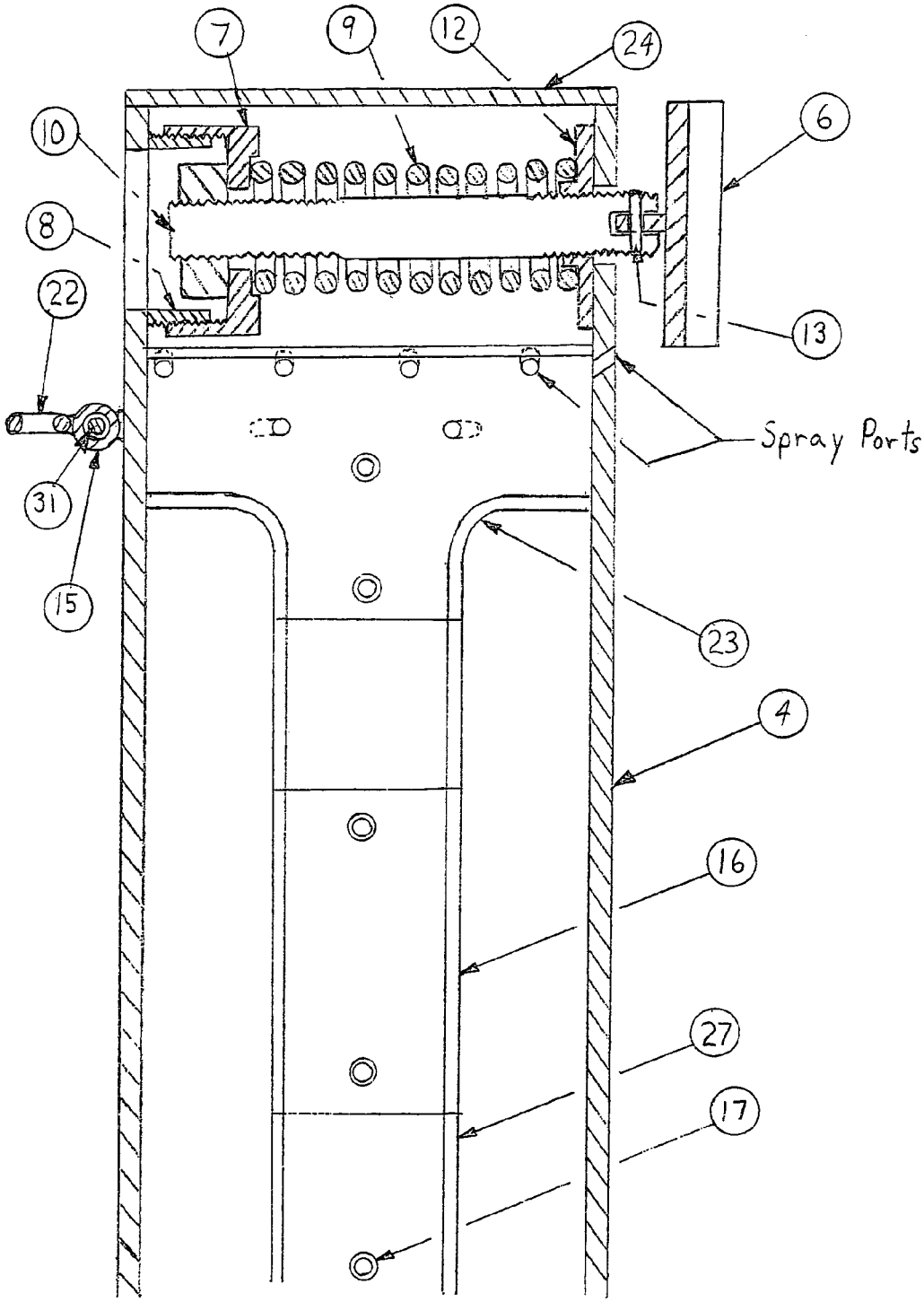

Figure 3 Section View CC Stop Log Slot Cleaning Machine
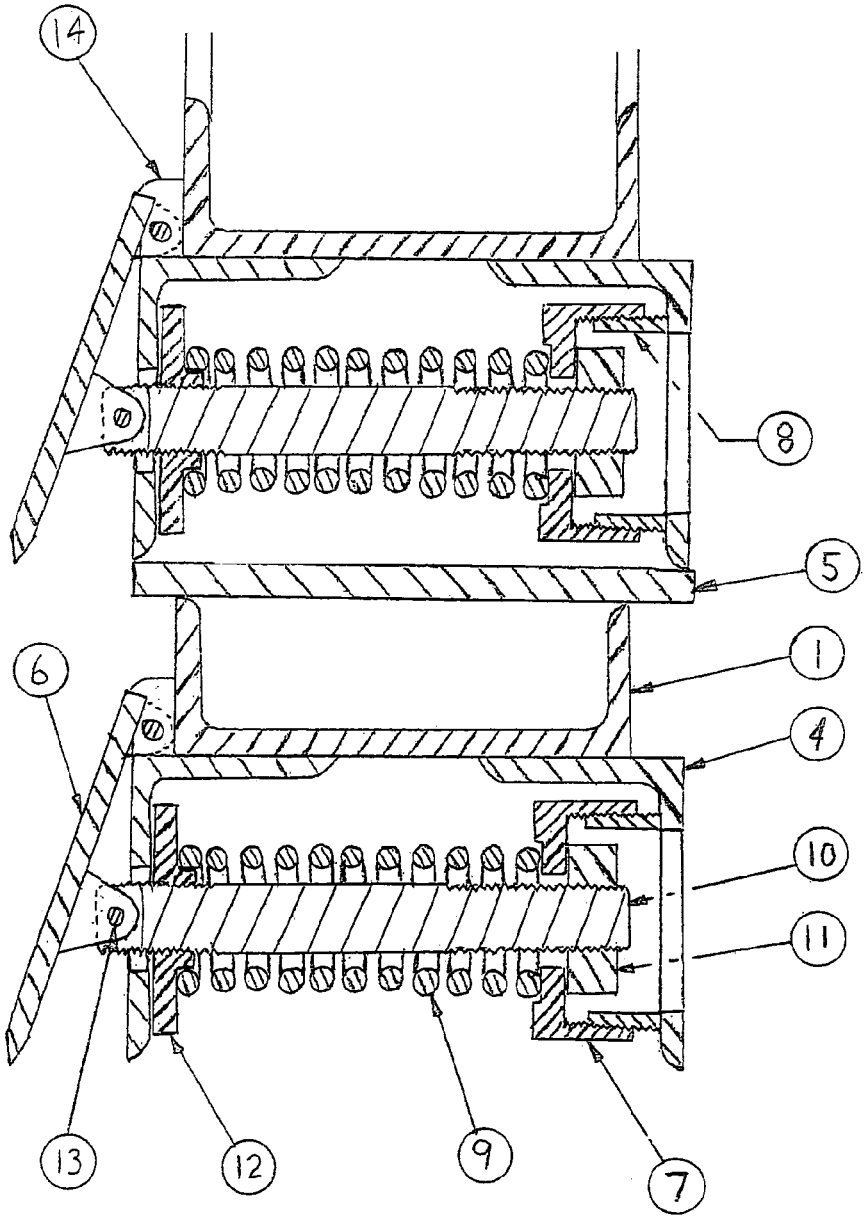

Figure 4 Section View DD Stop Log Slot Cleaning Machine
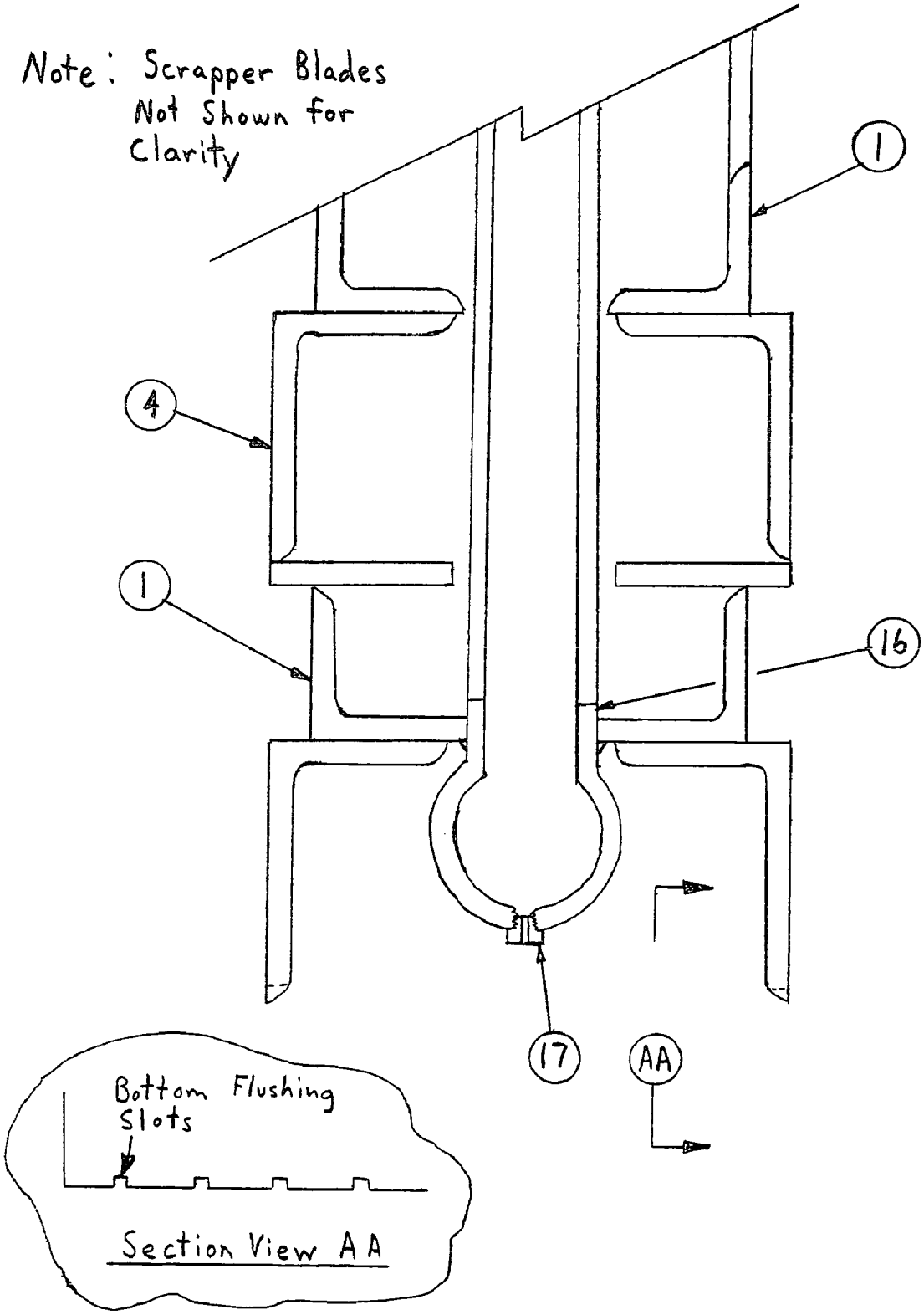

Figure 5 Rear View of Bottom Portion of Stop Log Slot Cleaning Machine
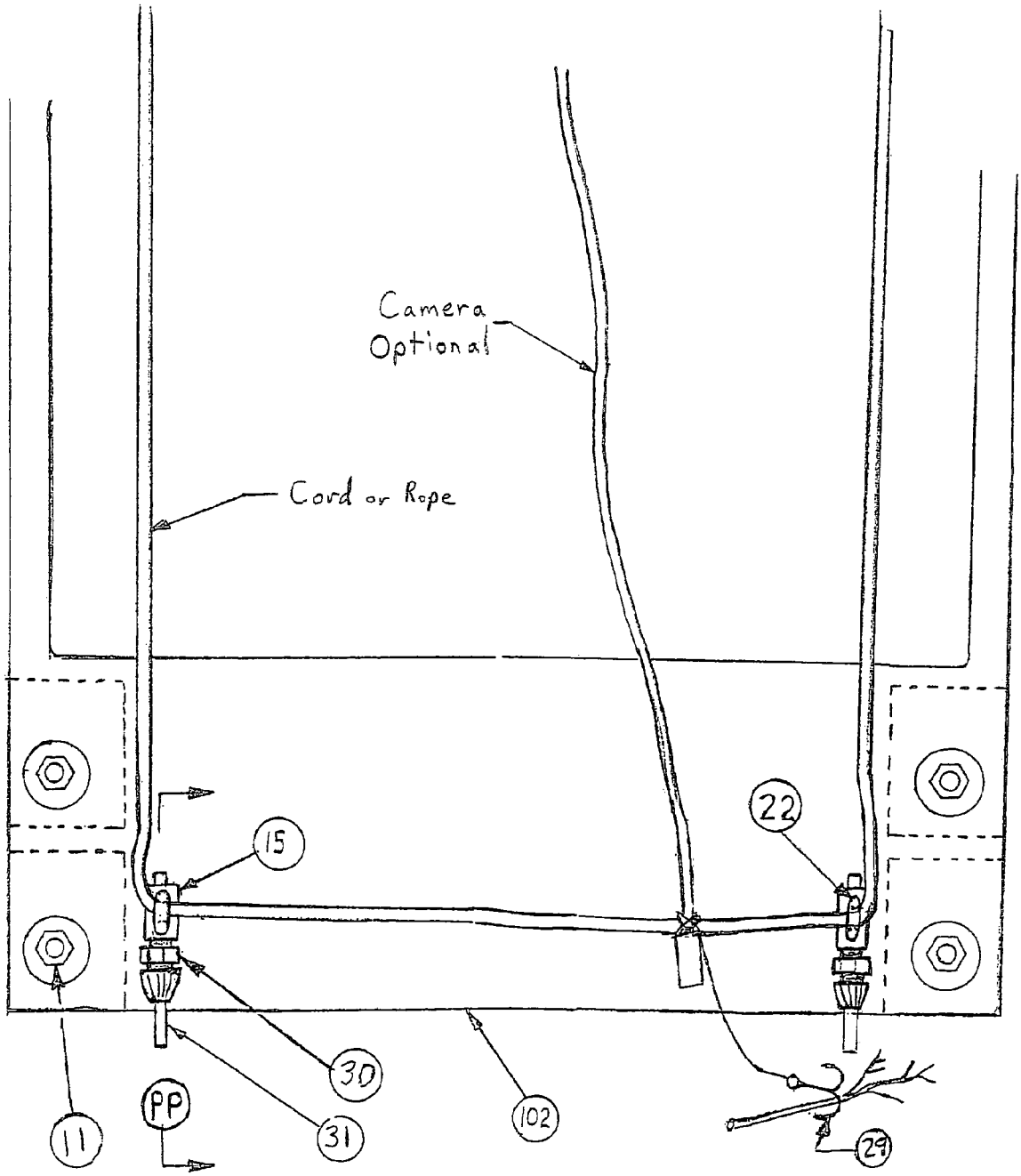

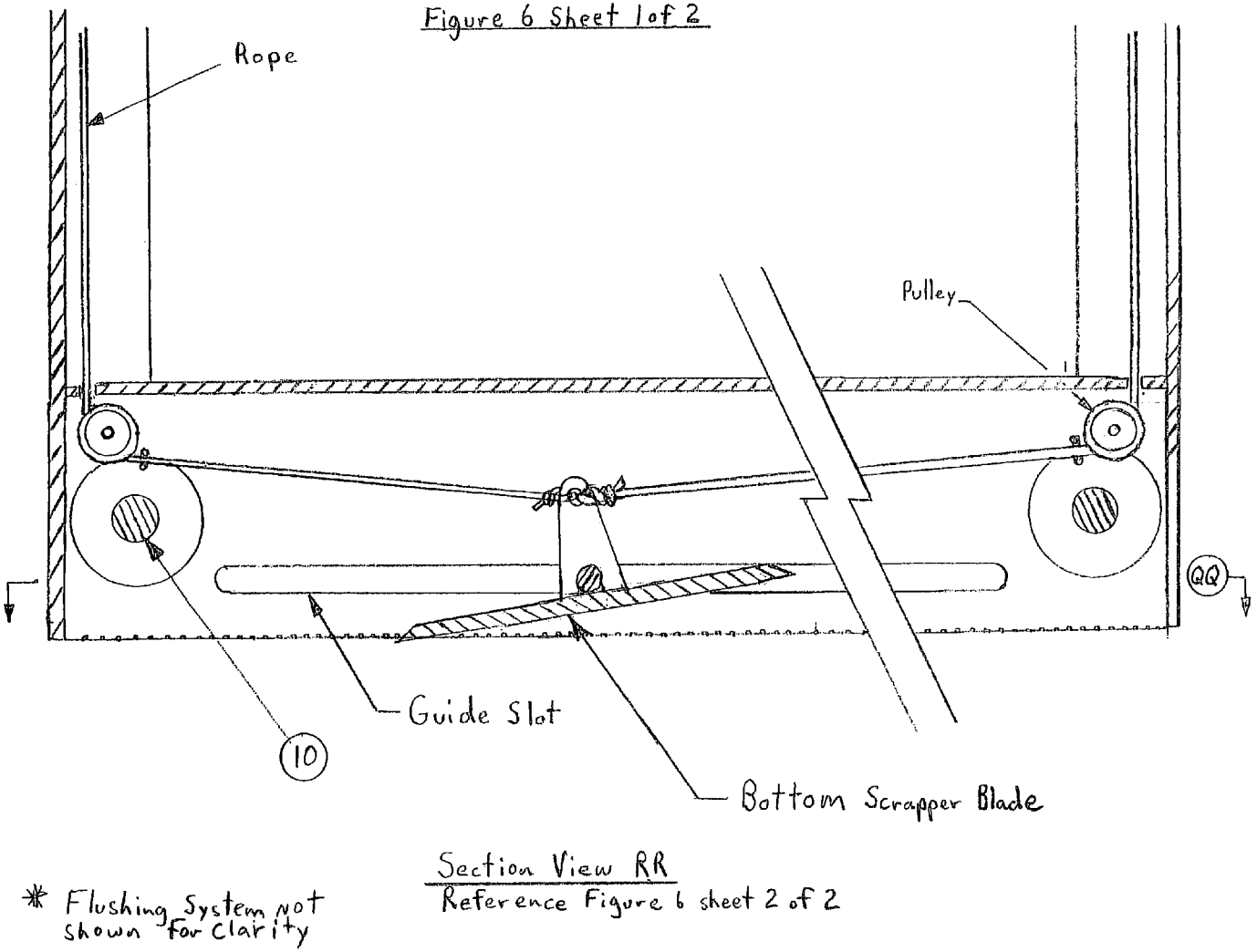
Figure 6 Sheet 1 of 2
Section View RR
Reference Figure 6 sheet 2 of 2
* Flushing System not shown for clarity Figure 6 Bottom Scrapper Sheet 2 of 2
Section View QQ Reference from Figure 6 sheet 1 of 2
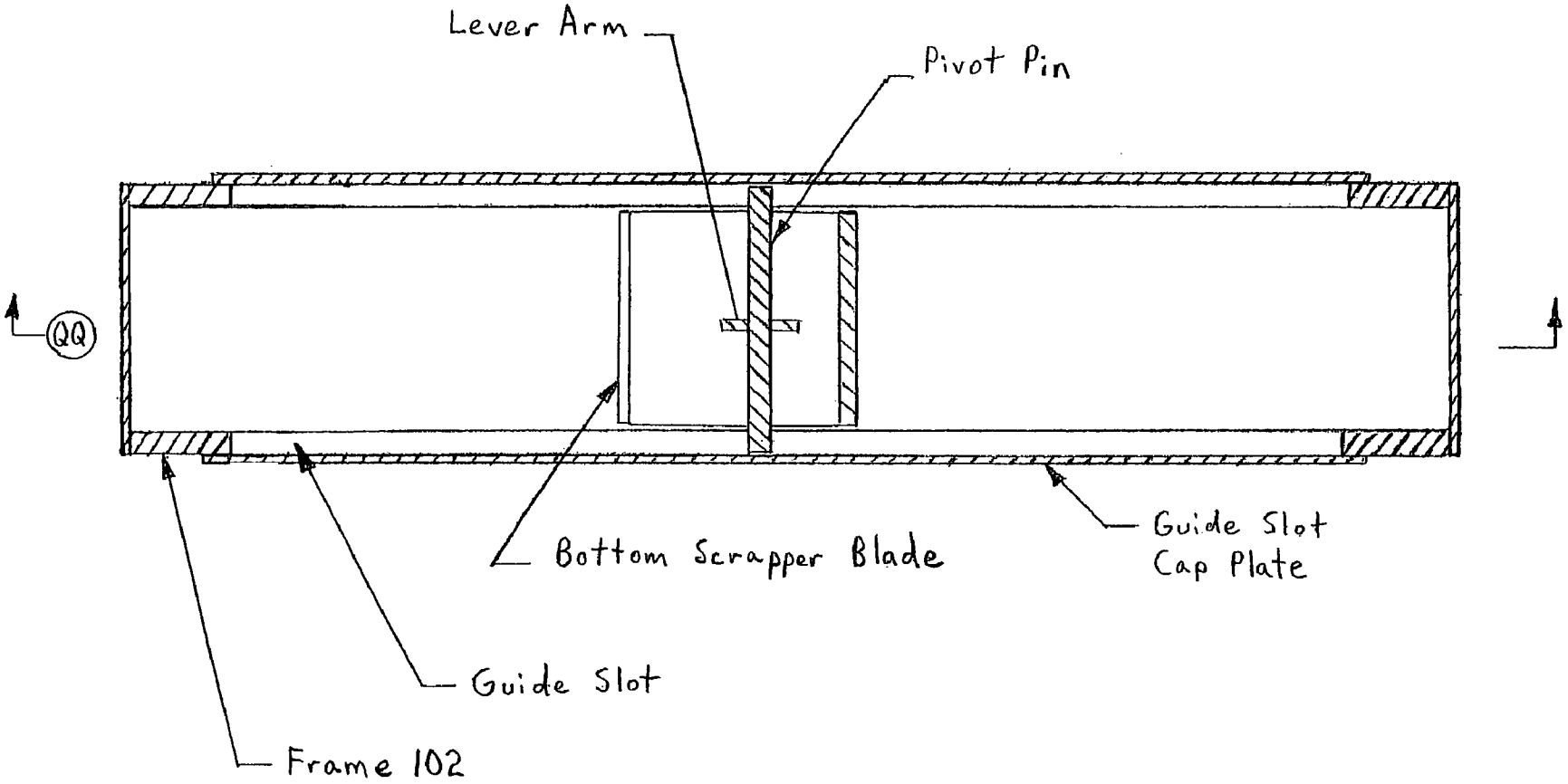

Figure 7 Scrapper Blade and Pins
Detail 1
Item # 6
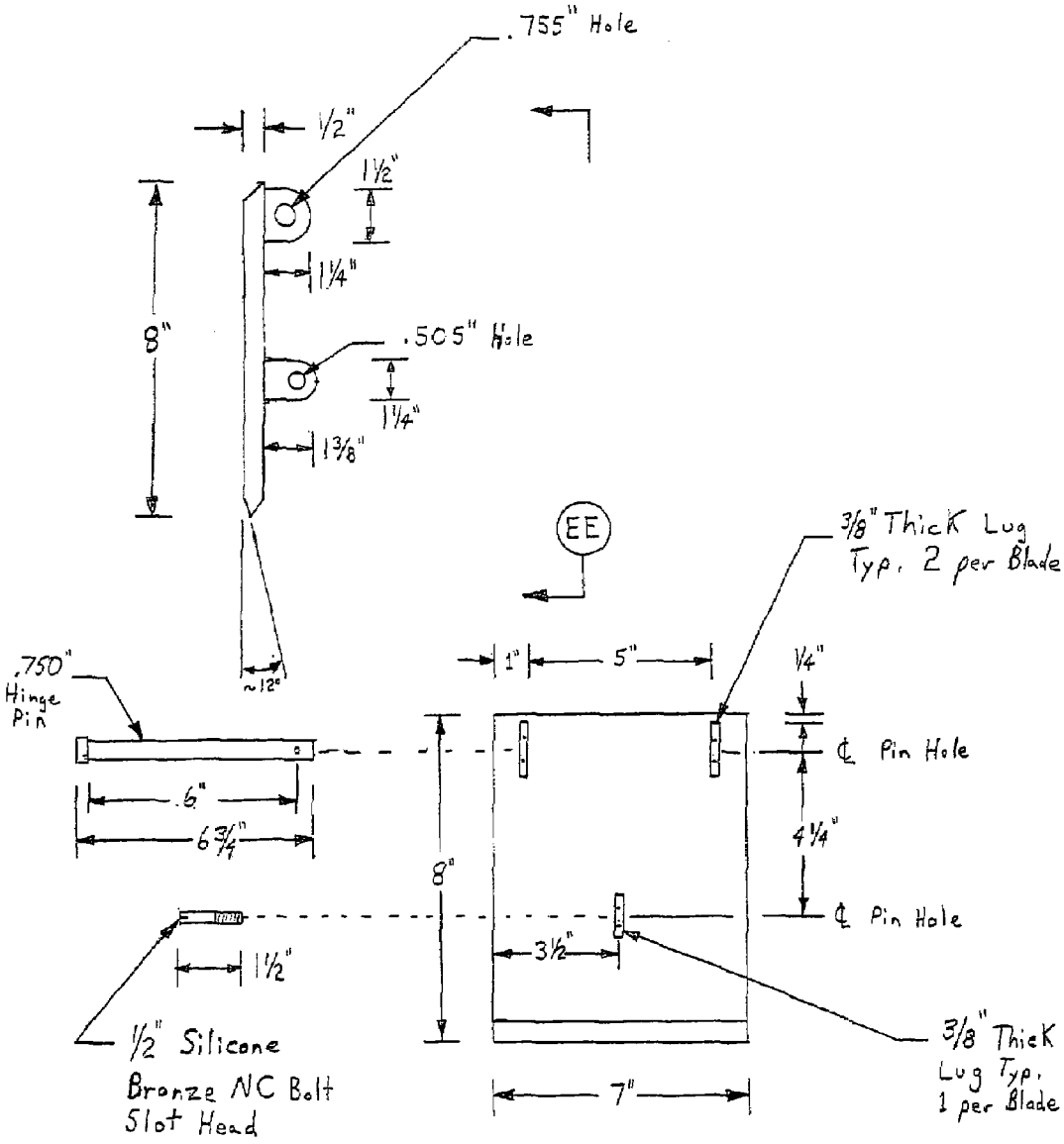
Section View EE

Stop Log Slot Cleaning
Machine Adjusting Cap Item #7

Notes

* Cap may be drilled and tapped for a set screw when the spring tension is set to desired setting.

Figure 9
Stop Log Slot Cleaning Machine
Adjusting Collar Item 8
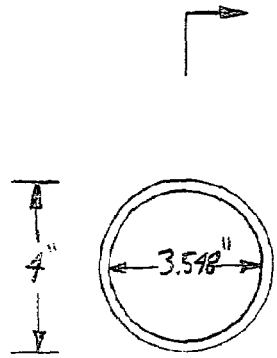
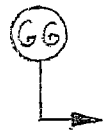
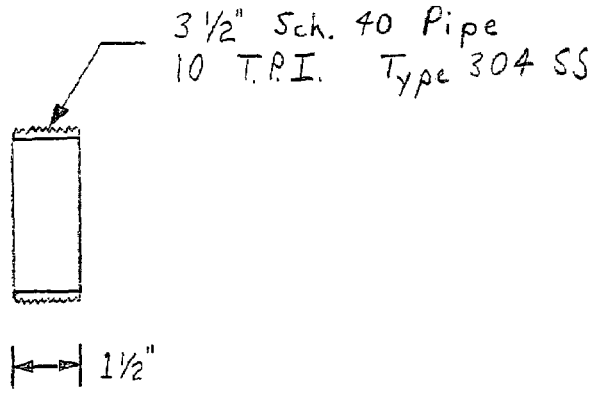
Section View GG
* Collar shall be welded to the frame. Details by field.

Figure 10
Blade Adjustment Rod
Stop Log Slot Cleaning Machine
Item # 10
Section View KK
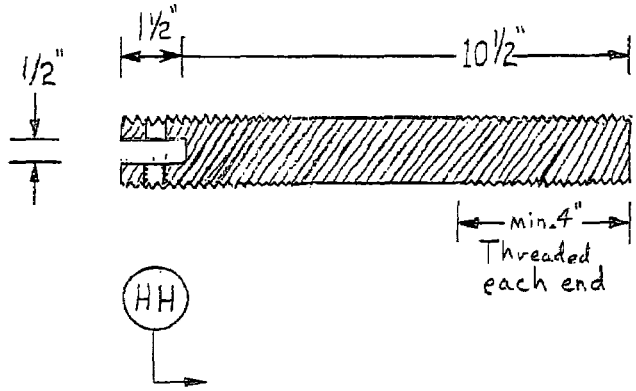
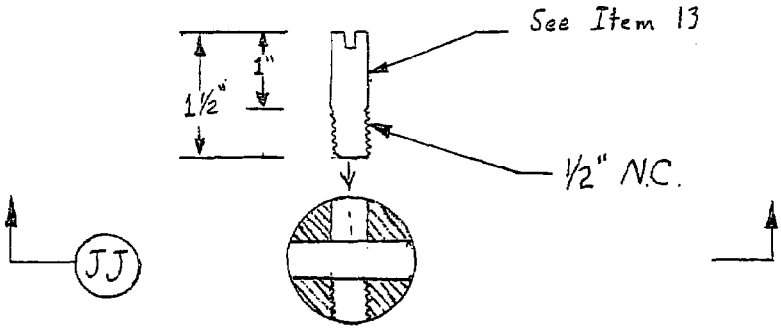
Section View HH
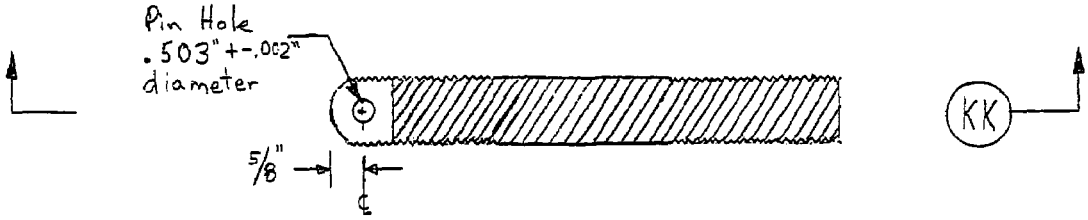
Section View JJ Figure 11
Spring Compression Plate
Stop Log Slot Cleaning Machine
Item 12
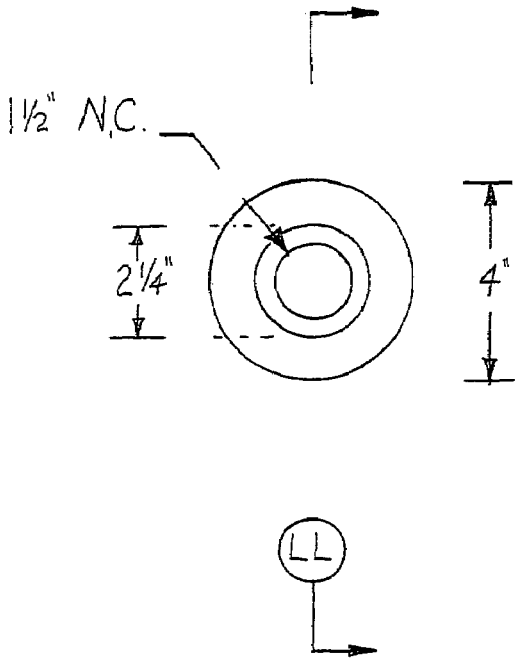
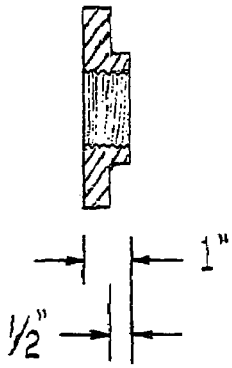
Section View LL Figure 12
Hinge Assembly
Detail 6
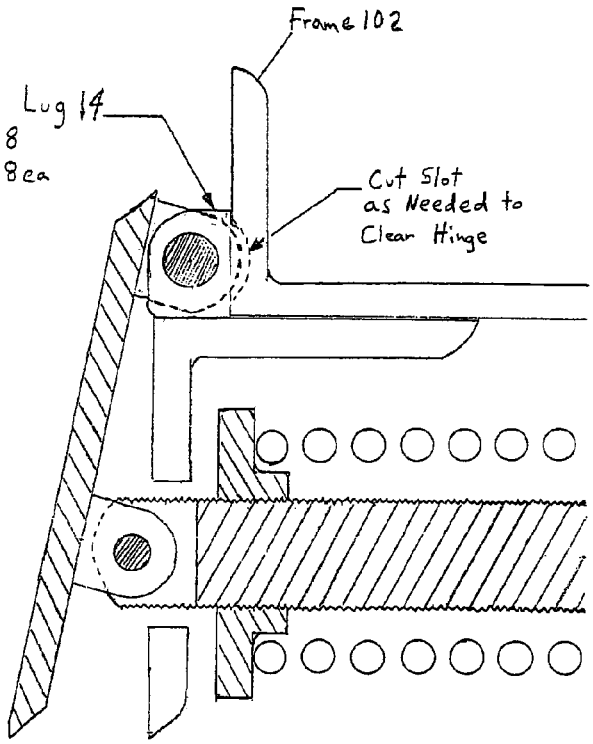
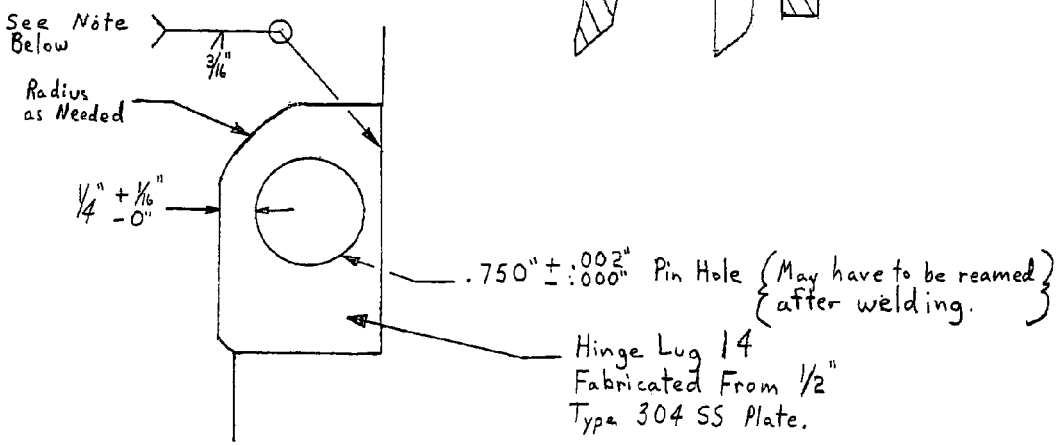
Detail 8
Note: In areas that are too close to the pin hole a seal weld should be substituted.

Figure 13 Stop Log Slot Cleaning Machine

Stop Log Slot Cleaning Machine 100
Operational View With Air Used

Note: If air is not used the air header shall be sealed to keep water pressure from bleeding through it.

Figure 15
Stop Log Slot Cleaning Machine
Detail 8 Lifting Lugs
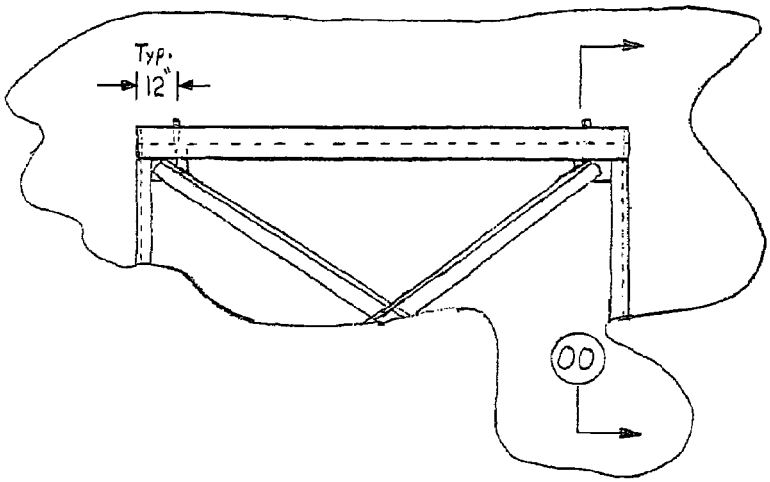
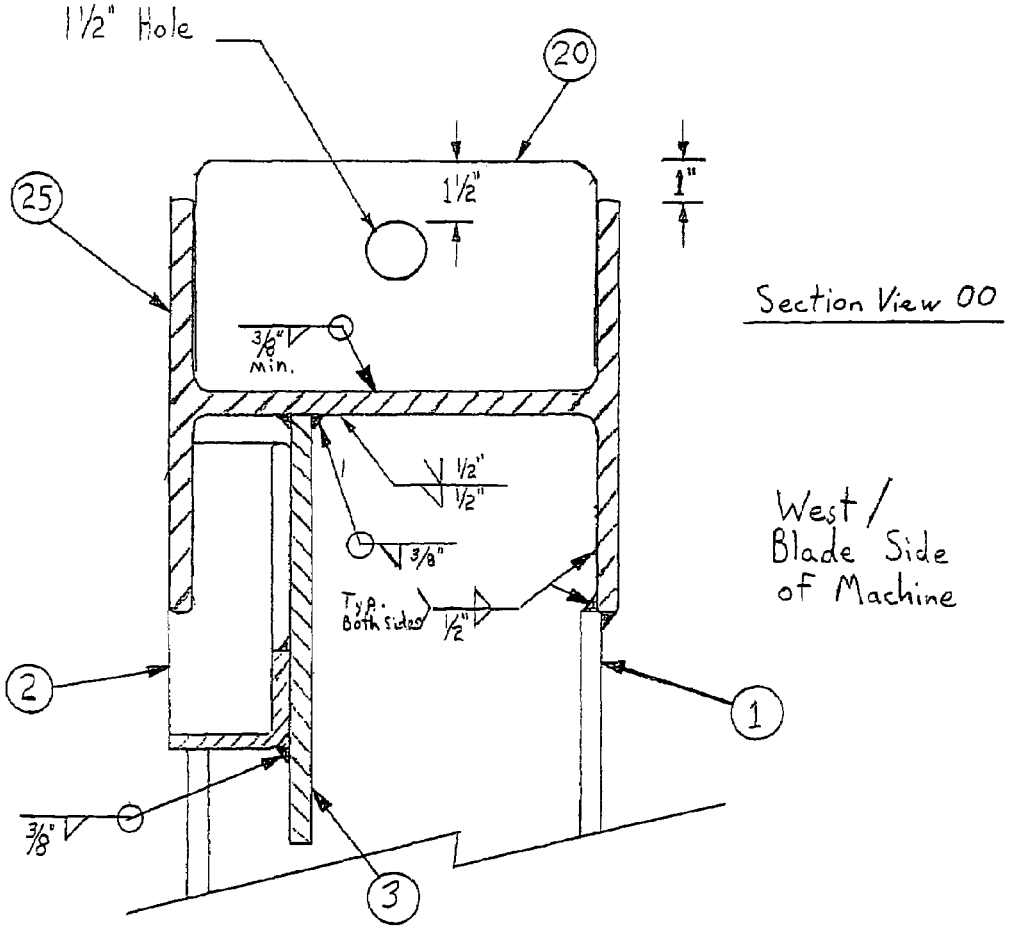

Flow Booster for Water Spray Header 103 (Optional for increased Flow)

Figure 17 Sheet 1 of 2
2 each Needed.
Section View SS
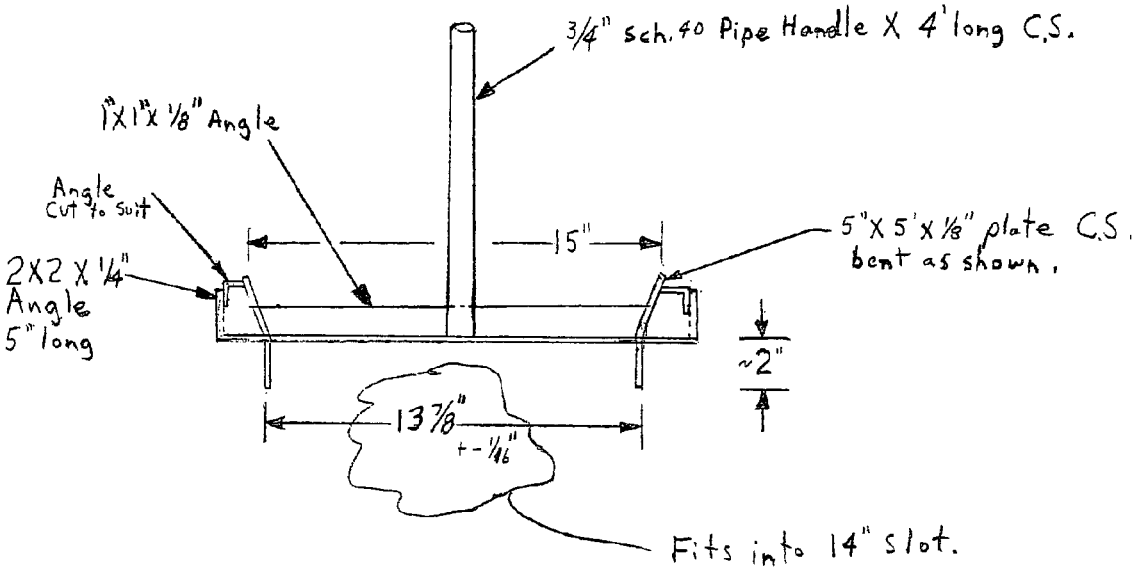
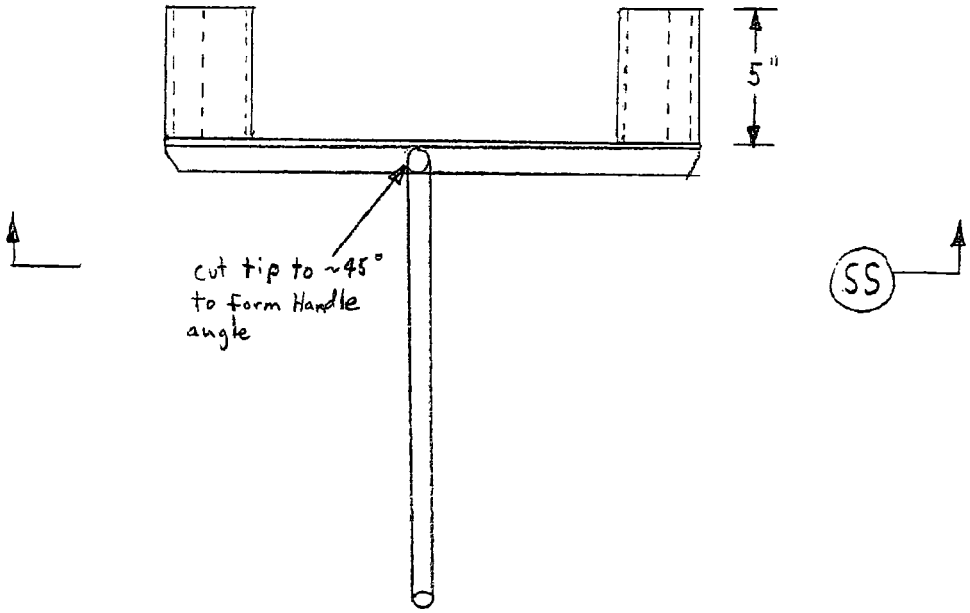

Figure 17 Sheet 2 of 2
Stop Log Slot Cleaning Tool Starter
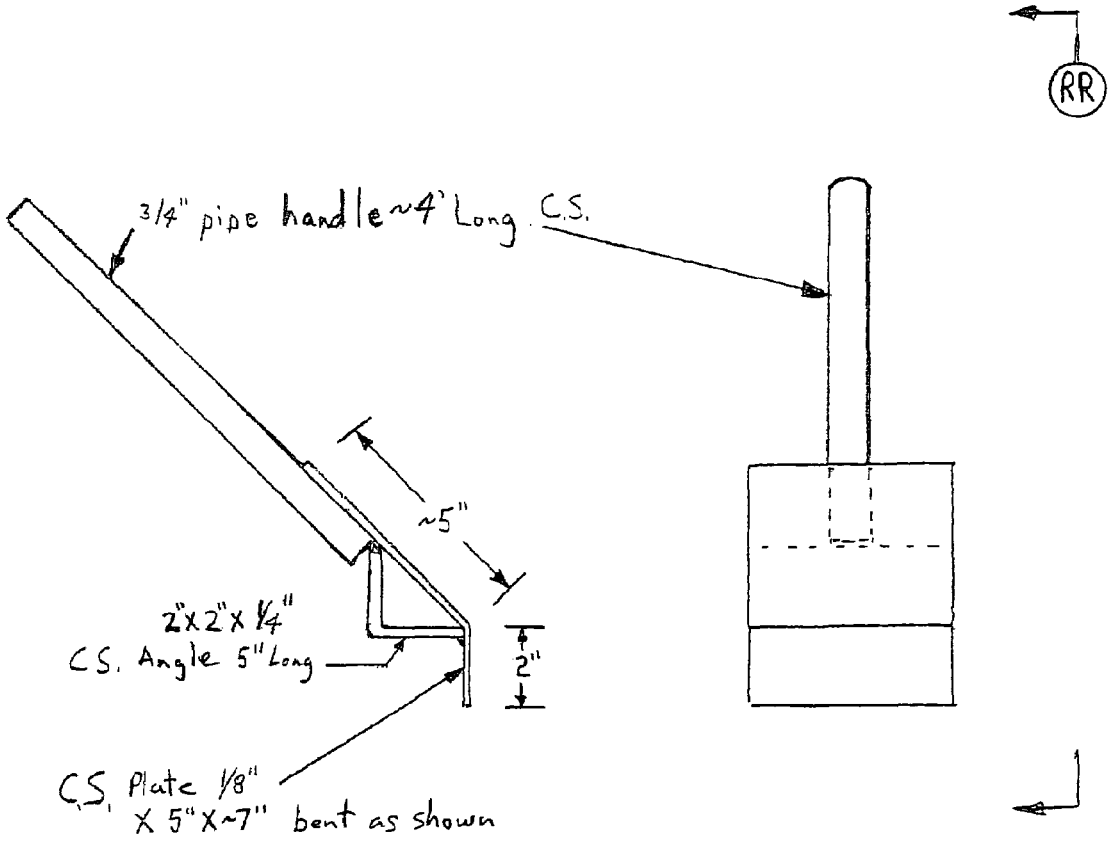
Section View RR Figure 18 Section View PP from Figure 13
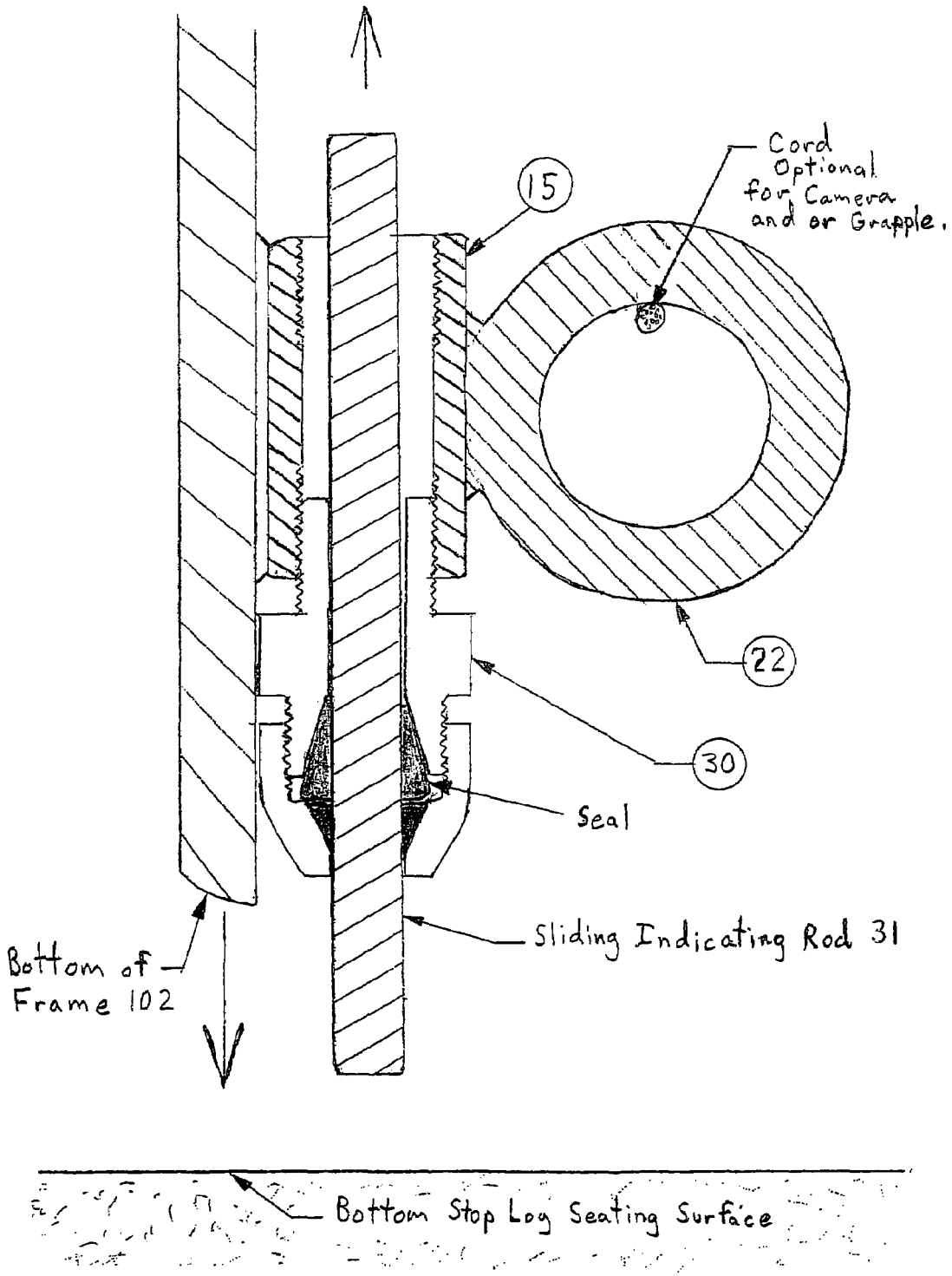

METHOD AND APPARATUS FOR STOP LOG SLOT/GUIDE SEALING SURFACE CLEANING

REFERENCE TO RELATED APPLICATION

Priority under 35 U.S.C. § 119(e) is claimed from U.S. Provisional Application No. 60/581,332, filed Jun. 18, 2004, the entire contents of which are incorporated by reference herein.

BACKGROUND OF INVENTION

The present invention relates to the industrial cleaning of stop log slots, sometimes referred to as stop log guides, by removing and flushing away both attached and loose debris such as marine life silt from the stop log seating surfaces using a frame and attachments without the need of human divers. Stop logs are commonly used in industrial applications such as power plant intake cavities, canals, and discharge conduits, tunnels and piping to provide a barrier or dam to allow water to drained or pumped out of an area or structure that is otherwise flooded. The areas or structures are normally drained for the purpose of allowing workers to enter the space and perform maintenance activities that either can not or are not cost effective to perform underwater. The stop log is basically a temporary wall that is lowered into a slot or guides that are embedded into a concrete structure sealing on the bottom and the edges on the side facing the space to be drained or pumped out acting as a dam. The guides/slots are commonly formed by two steel C-channels or a steel plate forming a shape similar to a C-channel with the open sides facing each other, with a smooth flat sealing surface at the bottom running between the channels, and open at the top end of each channel to allow the stop log to be inserted. The seals act as a gasket sealing against the seating/sealing surface of the embedded guides. When the water is pumped out of the space on one side of the stop log the differential pressure caused by water on the other side of the stop log compresses the seals sealing water out.

It is important that the seating surfaces be as clean and flat as possible to prevent leakage past the stop log seals and prevent damage to the seals during stop log installation. Marine life such as barnacles, shell fish and other debris trapped under seals can create a leak path by creating a rough seating surface or cutting or tearing the seal material. The traditional of cleaning the seating or sealing surfaces is to use divers with various handheld tools and machines that scrape, cut or scrub off attached marine life or debris which is then either flushed away with a hand held vacuum, water hose, water canon, or just manually pushed away from the seating surfaces.

The use of divers although effective is inherently dangerous, time consuming and expensive. The cleaning of stop log slots/guides also constitutes a confined space dive further increasing risk and legal requirements. The typical cost of a dive team exceeds $1,500 a day. This does not include the typical dive support including plant safety tagging to make the dive location safe, possible security depending on the facility, and other support functions that frequently accompany dive activities which can exceed the cost of the dive team. A typical stop log slot cleaning operation can require up to nine workers and can take eight hours. In spite of industrial safety regulations dive accidents continue to occur on a regular basis and do claim lives.

In addition the dive activity to clean stop log slots requires the system to be shut down to prevent the diver from being drawn into operating pumps and equipment. There is increasing pressure to reduce down time in the deregulated electric utility and other industry to remain competitive. Shortcuts or mistakes in this area occur too often and can have fatal consequences.

A typical stop log cleaning activity involves obtaining safety tag-out isolating the system to make the dive location safe, processing a truck load of dive equipment through security, setting up and dive equipment, a pre-dive job brief, the dive to clean the stop log slots, and break-down and reloading dive equipment at the end of the job.

Dive cleaning is done most commonly with a handheld scraper tool similar to a putty knife followed by a flush of the bottom with water or air pressure. The diver is suspended or floating in water and while he scrapes or cuts the attached marine life from the seating surface of the slot, making the job more difficult and time consuming. The diver force that is applied in scraping is also limited by the physical strength and endurance of the diver. Visibility for the diver is commonly low in this environment and gets worse during the cleaning operation due to stirring up silt and mud.

There are other tools available to divers to clean surfaces including hand held hydrolazers (higher pressure versions of pressure washers), handheld air powered or hydraulic powered rotating brushes that may include a vacuum attachment that removes debris that is removed by the brushes from the area. Although these tools can be effective, the supporting equipment is expensive, they are operated by divers, and can be a hazard to the diver himself. Hydrolazers require extreme caution and protective gear since the high pressure water jet can cut or inject into the diver and injure or kill them. Operating a hydrolazer while suspended in water adds to the risk. The risk of a rotating brush with a divers air lines floating in the area should be obvious. There is also the possible risk to the diver from sharks, barracuda, alligators etc. (depending on the job location) that may become interested in the food being stirred up by the cleaning operation.

SUMMARY OF INVENTION

To address the foregoing deficiencies in the prior art, the present invention is directed to a method and apparatus wherein a structure is designed to be lowered into stop log guides/slots using a crane or other lifting device, remove attached debris, and flush debris and marine life from the stop log seating or sealing surfaces as it is lowered. The machine greatly reduces time required to clean the stop log seating surfaces, greatly reduces the number of workers required, does not require expensive diver labor or dive equipment, is much lower risk than diving, and allows the cleaning operation to be performed with pumps and equipment operating which shortens equipment downtime increasing production and profits. More specifically, in accordance with the present invention, there is provided a method and apparatus for stop log slot cleaning utilizing scraping or cleaning devices to shear attached debris or marine life from the stop log seating surfaces, and a flushing system to flush the loose or dislodged debris away from the seating surfaces, and rigging points used to lift the machine. The apparatus of the present invention has approximately the same footprint when standing in the operating position as the stop log to be installed in the slot, is heavy enough and shaped in such a way as to prevent it from binding or becoming cocked or jammed while being lowered and raised in the slot. The machine may also be equipped with attachments for holding or maneuvering underwater cameras or grapple devices to remove heavy objects if needed. In addition gauges or detectors that indicate that the machine has reached the bottom seal surface, indicating that no large objects that could cause stop log leakage are present on the floor seating surface are attached to the machine.

DESCRIPTION OF DRAWINGS

FIG. 1 is a basic front side view of the stop log slot cleaning machine of the present invention with section view location indicators BB, CC, and DD which reference to other FIGS. 2, FIG. 3, and FIG. 4 that show those respective section views.

FIG. 2 shows a top cutaway view indicated as section view BB which shows the bottom left half of the spray header 103 comprising components pipe tee 16, pipe 27, pipe tee 23, spray port typical locations and angles, and stray nozzles 17, a scraper blade assembly 104 comprising components scraper blade 6, spring 9, rod 10, nut 11, adjusting cap 7, adjusting collar 8, spring compression plate 12, and portions of frame 102 including components side cap plate 24 and angle iron 4. Note that the right half of the machine is the same construction except opposite hand.

FIG. 3 shows a side cut away view as indicated by section view CC which shows scraper assembly 104 comprising components scraper blades 6, adjusting rod 10, adjusting cap 7, adjusting nuts 11, adjusting collar 8, spring 9, blade link pin 13, spring compression plate 12, hinge assembly 14, and portions of the frame 102 including components angle iron 4, C-channel 1, and plate 5.

FIG. 4 shows a side cutaway view indicated by section view DD which shows the frame 102 in the area of the where the water supply piping 21 penetrates the frame and joins the spray header 103. It also shows how the frame 102 components forms a channel and traps the discharge water pressure from the spray header 103 when the stop log slot cleaning machine frame 102 reaches and contacts the bottom. The pressure escapes through notches (shown on section view AA) when the frame 102 contacts the bottom forming water jets that flow horizontally along the floor pushing silt and debris away from the bottom of the stop log bottom seating surface.

FIG. 5 is a partial rear view of the bottom the stop log slot cleaning machine 100 showing eye loops 22 which can be used to maneuver a camera and/or a grapple device 29 if needed using a rope. It also shows access ports to the scraper blade adjusting nuts 10, and an example of bottom indicator gauges 30 used to indicate that the stop log slot cleaning machine has contacted the bottom when a camera is not used. It also provides the location of section view PP found on FIG. 18 for bottom indicator gauge 30 details.

FIG. 6 shows an example of a bottom scraping mechanism that can be incorporated into the bottom of the machine if there is attached marine life present on the bottom stop log seating surface.

FIG. 7 shows an example of a scraper blade 6 including hinge pin 31 and blade link pin 13.

FIG. 9 shows an example of adjusting collar 8.

FIG. 10 shows an example blade adjusting rod 10 and blade link pin 13.

FIG. 11 shows an example of spring compression plate 12.

FIG. 12 shows an example of an assembly detail for scraper blade 6 to a hinge lug 14 and link pin 13 attachment to the end of blade adjusting rod 10, spring compression plate 12 and spring 9 on the rod 10, with a construction detail for hinge assembly 14.

FIG. 15 shows an example of attachment of lifting lugs 20 at the top of frame 102.

FIG. 17 sheets 1 and 2 show examples of scraper blade starter tools that can be used to compress the scraper blades 6 and springs 9 while the bottom of the stop log slot cleaning machine 100 is started into the top of the stop log slot.

FIG. 18 shows a section view PP (location indicated on FIG. 13) of an example of a bottom indicator gauge 30 and how it attaches to the frame 102 through coupling 15. It also shows eye loop 22 welded (for example) to coupling 15 and the optional cord used to maneuver the camera and/or grapple device 29 if they are used. It shows the sliding indicating rod portion of bottom indicating gauge 30 as it would be positioned prior to the machine frame 102 contacting the bottom stop log seating surface, indicates the direction of frame 102 movement and the direction that the sliding indicating rod will move when the tip contacts the bottom.

DETAILED DESCRIPTION OF THE PREFERRED EMBODIMENT

Figure 8:
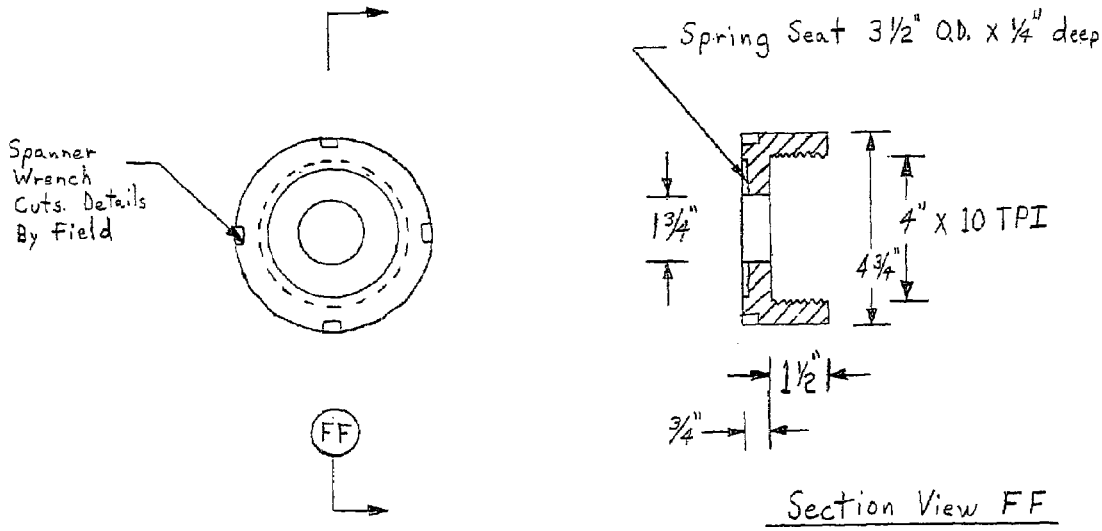
FIG. 8 shows an example of adjusting cap 7.

Turning first to FIG. 1, there is illustrated an overall basic front view of the stop log slot cleaning machine 100 in accordance with the present invention and showing locations of section views BB, CC, and DD. The stop log slot cleaning machine 100 comprises structural frame 102 constructed of, for example, structural steel components 1, 2, 3, 4, 5, 24, 25, and 26, with lifting lugs 20, water supply hoses 19, water supply pipes 20, optional air supply line 18, adjustable spring loaded scraper blades 6 (shown in details on FIG. 2), and phantom/dotted lines showing the outline of the spray header 103 (details shown in FIG. 3). The frame 102 is preferably constructed of structural steel held together using welds, bolts and/or by means of another fastener system and provides a structure to attach the scraper blades 6 and to hold them in position against the seating surface of the stop log slot being cleaned. Frame 102 further provides an amount of weight necessary to produce downward force necessary to drive the scraper blades 6 through and shear off attached marine life such as clams, barnacles, oysters, etc. Frame 102 also preferably provides a structure that houses the spray piping 21 and spray header 103, and preferably forms a channel at the bottom of the of the frame 102 which surrounds and protects the spray header 103 on the sides and top and traps header discharge pressure between the channel and bottom of the stop log slot as the machine approaches the bottom causing pressure to escape through notches in the bottom edges of the frame 102 forming horizontal jets or streams of water and/or air to flush debris away from the bottom seating surface.

In a preferred embodiment, the stop log slot cleaning machine 100 of the present invention provides adjustable spring loaded scraper blades 6 to allow them to flex in and out in order to compensate for variations in stop log slot channel width that may occur as a result of corrosion or manufacturing tolerances, and to allow the scraper blades 6 to flex and collapse allowing the machine to be easily extracted from the stop log slot should it become stuck or wedged while being lowered into the slot. The adjustable spring tensioning feature allows the cutting edge of the scraper blades 6 to press against the seating surface being cleaned with zero to hundreds of pounds of force depending on the strength of spring 9 and the nature of marine life or debris being removed. Adjustments also allow the front to back thickness of the stop log slot cleaning machine to be adjusted as needed to fit into the stop log slot width. The height, width, and thickness of the stop log slot/guide cleaning machine will be determined by the dimensions of the stop log slot/guides being cleaned.

The spray header 103 preferrably has spray nozzles 17 and/or spray ports incorporated into it and directs jets of water or air or both to stir up and push loose or dislodged debris away from the stop log seats. Since the majority of the debris will be removed from the vertical seats of the stop log slots as the machine is lowered, it is important to churn and scatter the debris as it is scraped from the surface by pointing one or more pressure ports into the channel that forms the slot to prevent accumulation of debris at the bottom corners of the stop log slot. In addition pressure ports optionally can be used to flush cut debris from under the scraper blades 6 if desired.

The scraper blade assembly 104 must be of sufficient strength to prevent damage if the scraper blade 6 contacts a hard object or large pit or damaged area in the seating surface while being lowered into the slot.

In addition to the basic scraping and flushing the stop log seats function the stop log slot cleaning machine may optionally comprise attachment points or loops used to maneuver a camera and/or grapple device using a rope as shown in FIG. 5.

In a preferred embodiment, bottom indicating gauge 30 is provided as shown in FIGS. 5 and 18 to provide a visual and/or physical indication that the machine has reached the bottom seating surface when a camera is not being used. The bottom indicating gauges as shown in FIG. 18 comprise, for example, strain relief fittings commercially available and commonly used to grip and seal around the outside diameter of electrical cords or similar items, threaded into a pipe coupling 15 which is attached to the edges of the machine with a gauge indicating rod 31 installed instead of a cord through the fitting. The strain relief fitting/bottom indicating gauge 30 is tightened causing it to grip the outside diameter of the indicator rod 31 tight enough to hold it, but loose enough to allow it to slide when pushed by hand on the ends. With the strain relief fitting at or just above the bottom edges of the frame 102 the gauge indicating rod 31 is pushed down until it extends below the edges of the frame 102 prior to lowering the machine into the slot. When the machine reaches the bottom the gauge indicating rods 31 will contact the hard bottom seating surface and be pushed through the strain relief fittings/bottom indicating gauge 30 until the machine 100 contacts the bottom or stops going down. When the machine is lifted the tips remain in this position due to the friction of the strain relief fitting/bottom indicating gauge 30 seals against the gauge indicating rod 31. If the tips of any of the indicating rods 31 are still extended below the bottom edge of the frame 102 the machine may not have reached the bottom. This indicates that a solid object may be stopping the machine, and it may be necessary to use the camera and/or grapple device 29 to remove it. Any number of bottom gauges may be used, however a minimum of two on opposite sides of the machine are recommended since a solid object could compress an individual gauge giving a false indication.

Blade starter tools shown on FIG. 17 sheets 1 and 2 are recommended to be used to help compress the scraper blades 6 acting to similar to a shoe horn guiding the machine into the slot without catching on the top edges of the slot. The version of the starter shown on sheet 2 of 2 is much like a shoe horn with an angle iron on the back to rest on the deck surface adjacent to the top end of the stop log slot supporting any downward pressure that may result as the machine is lowered against it. The machine may have to be held against this starter depending on how much spring tension is used on the scraper blades 6 and whether or not the distance from the back face of the frame 102 to the front tip of the scraper blades is greater than the width of the stop log slot/guide channel. The version shown on FIG. 17 sheet 1 of 2 must be made to fit the specific stop log slot being cleaned. It provides a common handle between two ramps, one that the back of bottom corner of the frame rides down and the other that scraper blades 6 ride down compressing the blades and guiding the frame into the slot as it is lowered. This version is also equipped with angles behind the ramps to supporting any downward pressure that may result as the machine is lowered against it. This version may also be made with adjustable distance between the two ramps if desired to allow a single starter to be used on different size stop log slots.

There are many modifications and substitutions will be apparent to those skilled in the craft without departing from the spirit of the present invention. Examples of modifications and substitutions include but are not limited to the following:

- making the frame 102 width, thickness, and height adjustable;
- making the scraper blades position fixed or adjustable without being spring loaded;
- using more or fewer scraper blades on the frame;
- using the frame to scrape the seating surfaces;
- using hydrolazers in place of scraper blades;
- using rotating brushes in place of scraper blades;
- using the frame without external flushing apparatus, such as nozzles or the like, when fluid current is present due to pump operation, natural flow or the like, to flush away the detached matter;
- making the machine much shorter and attaching it to the bottom of an actual stop log, in which case the stop log holds the short frame level and provides the weight needed to force the blades 6 down through marine life;
- building scrapers or hydrolazer or flushing nozzles into an actual stop log;
- using rotating brushes in the bottom seal area of the machine;
- using one or more air powered water canons instead of an external water supply to feed flushing water and air pressure into areas to be flushed with or without use of a spray header or nozzles or ports (a water canon is a cylinder or pipe with a smaller compressed air tube that blows down the center of the pipe toward one end of the pipe or cylinder forming a venture, drawing water in one end and blowing or blasting water and compressed air out the other);
- blowing water and/or compressed air into the frame channel without using a spray header or nozzles;
- using vanes at the water or air injection point to direct flushing flow into desired areas instead of using nozzles or ports;
- using materials other than metal to construct components of the machine;
- building a frame that inserts into the stop log slot, is left there during system operation covering the seating surfaces prevention marine life attachment, and then being pulled from the slot leaving clean surfaces when stop logs are to be installed;
- building a rotating scrubber or scraper belt into the bottom channel to clean attached marine life from the bottom seating area if it is present (a flushing system may or may not be included in this frame); and building a sliding or rolling scraper or hydrolazing nozzle into the bottom channel of the machine frame to clean attached marine life from the bottom seal area. Refer to FIG. 6, sheets 1 and 2 for an example of a scraper blade type bottom cleaning system.

FIG. 6 shows an example of a preferred scraper blade system according to the present invention that is designed to scrape attached marine life off of the bottom seating surface. The blade is double edged with a pivot pin attached to the top center and a lever arm on the top side. The pivot pin ends ride in a horizontal direction in the lubricated guide slots in the bottom frame channel when the cord attached to the lever arm is pulled. The lever arm configuration also causes the cutting edge of the blade to press down on the side pointing in the direction that the blade is sliding shearing the marine life from the surface as it goes. When the cord is pulled in the other direction the blade pivots causing the other edge to press down on the seating surface and to scrape the seating surface in the other direction. The tight clearance between the sides of the blade and the frame combined with the pivot pin location on top of the blade prevent the blade from getting into the guide slot in the frame and becoming jammed or cocked. Pulleys may be equipped with retainers to keep the cord in the pulley even when the cord is slack.

The spray header system shown in FIGS. 1, 2, and 4 is designed for applications where mud and silt are present on the bottom of the stop log slot preventing marine life from attaching. This silting is a common condition in many locations. Under this situation the flushing header is all that is needed to clean the bottom seating surface. This bottom cleaning system is simple with no moving parts, and where silt is consistently present is preferable to the system described in the paragraph above, or other bottom cleaning systems with moving parts. The machine design should only be as complex as is necessary to consistently perform its design function.

The following is an exemplary list of materials which may used in the construction of a stop log slot cleaning apparatus according to the present invention. Additional modifications and substitutions will be apparent to those skilled in the craft without departing from the spirit of the present invention.

Figure 13:
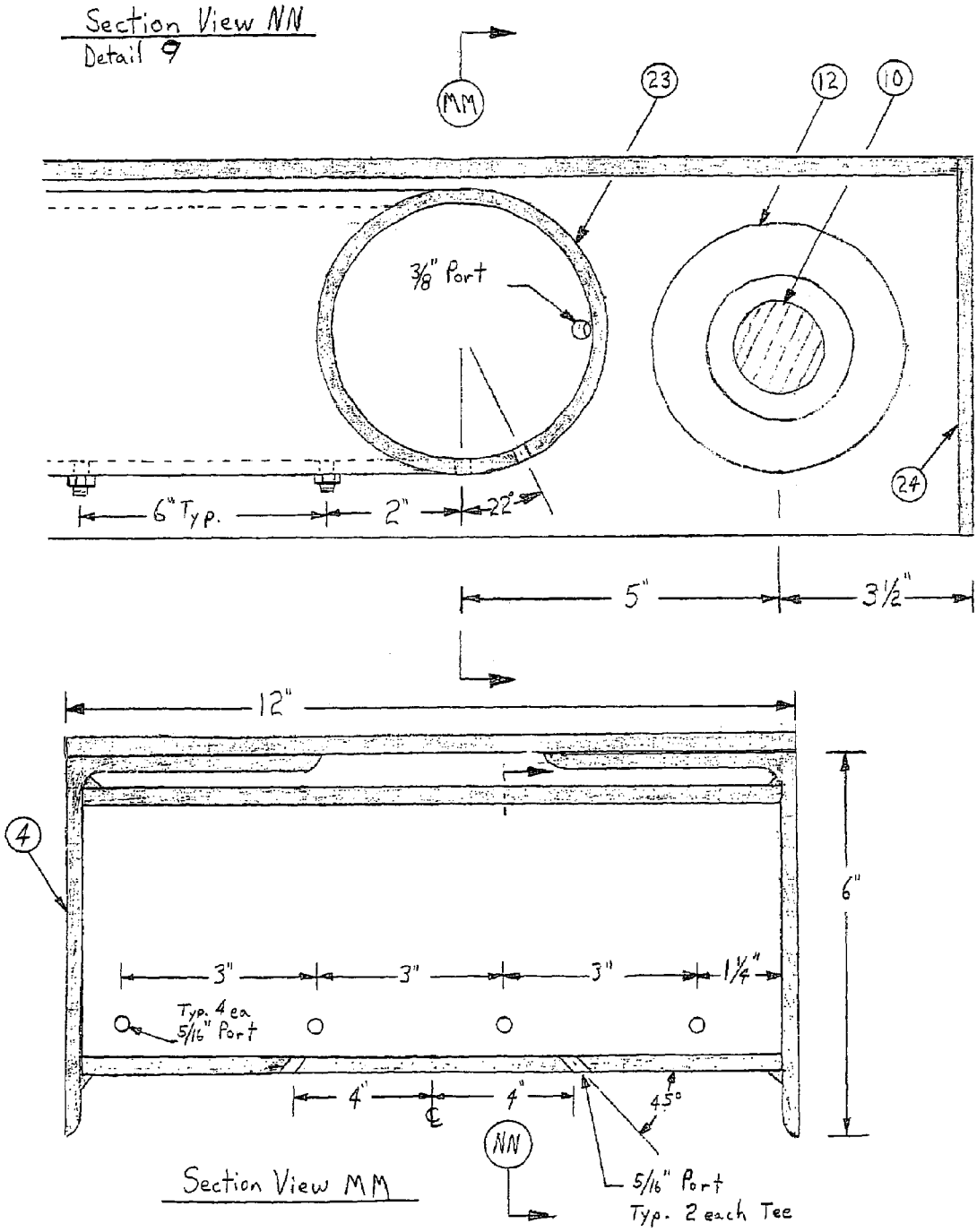
FIG. 13 shows an example of a construction and assembly detail showing flushing port and nozzle 17 locations and angles on the spray header 103 relative to the spring compression plate 12 and blade adjusting rod 10, and cap plate 24.
Figure 14:
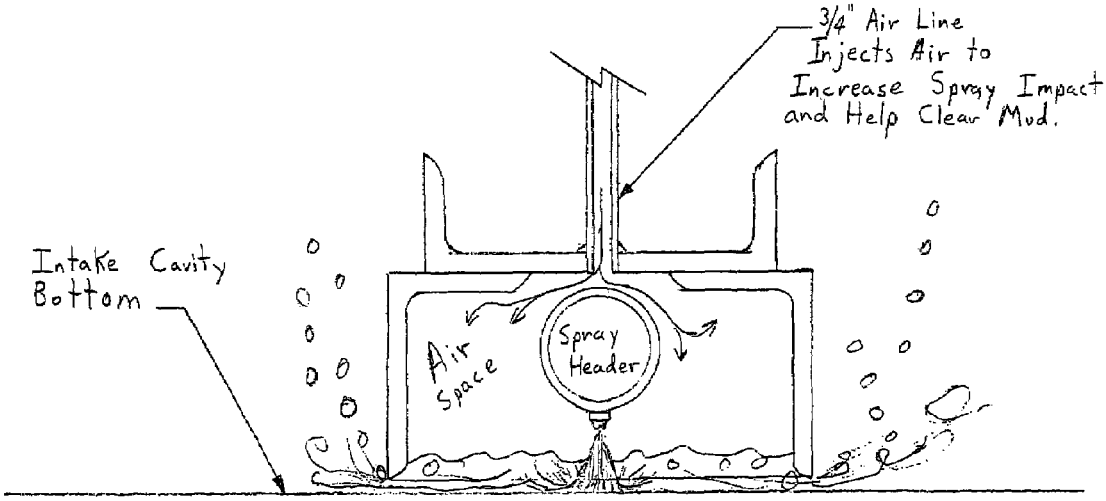
FIG. 14 shows an example of an operational cutaway view of the spray header 103 discharging into the channel formed by the bottom of the frame 102 while it is being supplied with air through air line 18.
Figure 16:
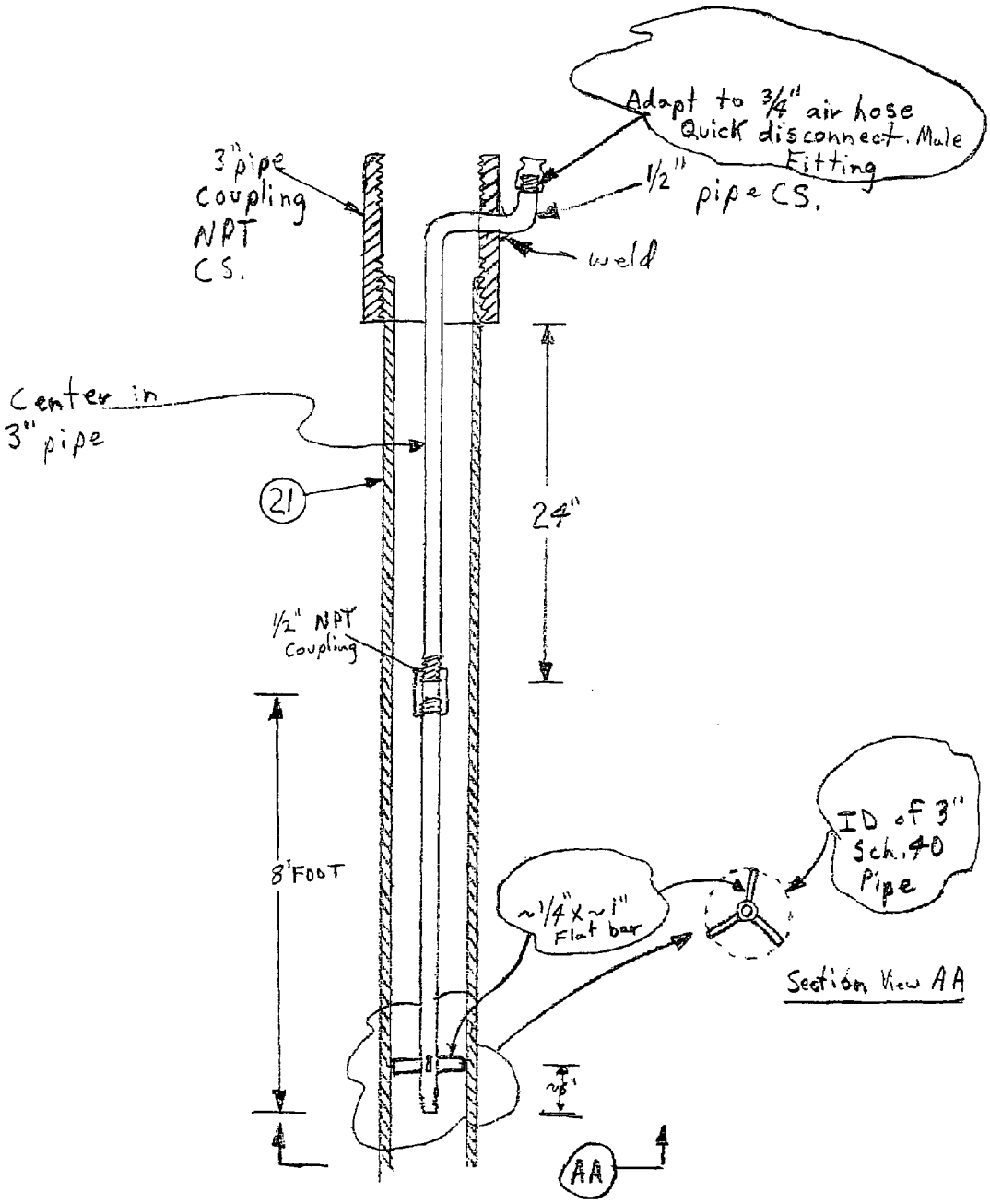
FIG. 16 shows an example of a flow booster that may be added into the water supply lines 21 if additional flushing force is desired.

| Item # | Quantity | Material | Description |
|---|---|---|---|
| 1 | 70 ft. | Carbon Steel | Channel MC 10" × 25 lb/ft, component of frame 102 |
| 2 | 56 ft. | Carbon Steel | Angle 3" × 3" × ½" cross bracing component of frame 102. |
| 3 | 8 ea | Carbon Steel | Plate ½" × 10" × 10" approximately, corner gusset component of frame 102. |
| 4 | 48 ft. | Carbon Steel | Angle 4" × 6" × ⅝", forms the channel at the bottom of machine, component of frame 102. |
| 5 | 1 ea | Carbon Steel | Plate 11' 10" × 12" wide × ¾" thick, component of frame 102. |
| 6 | 4 ea | 304 SS | Scraper blade, see FIG. 7 for details. |
| 7 | 4 ea | Silicone Bronze | Adjusting Cap, see FIG. 8 for details. |
| 8 | 4 ea | 304 SS | Adjusting Collar, see FIG. 9 for details. |
| 9 | 4 ea | Centerless Ground HR 5150 H Alloy Steel | Spring 8" long × 2½" OD. × .43" diameter wire, blade compression spring. |
| 10 | 4 ea | 304 SS | Rod, see FIG. 10 for details. |
| 11 | 4 ea | 304 SS | Nut 1½" NC. |
| 12 | 4 ea | Silicone Bronze | Spring compression plate, see FIG. 11 for details. |
| 13 | 4 ea | Silicone Bronze | Pin, see FIG. 10 for details. |
| 14 | 8 ea | 304 SS | Hinge Lug, See FIG. 12. |
| 15 | 2 ea | 304 SS | Pipe Coupling ¾" NPT |
| 16 | 2 ea | 304 SS | Pipe Tee 3" branch × 4" run sch. 40 |
| 17 | 20 ea | 316 SS | Nozzle ½" NPT OD. with ¼" straight port ID. |
| 18 | 2 ea | 304 SS | Pipe ¾" sch. 40, air line, refer to FIGS. 1 and 14. |
| 19 | 2 ea | | Fire hose 3" |
| 20 | 2 ea | Carbon Steel | Lifting lug, see FIG. 15. |
| 21 | 2 ea | 304 SS | Pipe 3"sch. 40, flushing water line, see FIG. 1 |
| 22 | 2 ea | 304 SS | Eye loop, see FIG. 5 and 18 |
| 23 | 2 ea | 304 SS | Pipe tee 4" sch. 40, see FIG. 2 and 13. |
| 24 | 2 ea | Carbon Steel | Cap plate 12" × 2½" × ⅜", component of frame 102. |
| 25 | 1 ea | Carbon Steel | Head beam W 10" × 88 lb/ft × 11' 10" long, component of frame 102. |
| 26 | 2 ea | Carbon Steel | Plate 2½" × 6" × ½" thick, see FIG. 1, component of frame 102. |
| 27 | 1 ea | 304 SS | Pipe 4" sch. 40, spray header, see FIG. 2. |
| 28 | 1 ea | Carbon Steel | Grapple device may include large treble hooks for added snagging power. |
| 29 | 2 ea min. | Plastic + Rubber | Strain relief coupling/fitting, see FIG. 5 and 18. |
| 30 | 2 ea min. | 304 SS | Indicating rod, round ½" OD. about 6" long, see FIG. 5 and 18. May be solid or tubing. |

What is claimed is:

1. An apparatus for cleaning a stop log slot/guide, said slot/guide having at least one gasket sealing surface thereon, comprising:

a frame, removably positioned in said slot and operable to be raised and lowered within said slot, a scraper, coupled to said frame and oriented substantially parallel to a direction of movement of said frame, said scraper being operable to scrape said at least one stop log gasket sealing surface to detach attached matter therefrom when said frame is lowered within said slot;

a flushing system positioned proximate said scraper to help remove the detached matter from the at least one stop log gasket sealing surface as the frame is lowered within said slot; and a position indicator, coupled to said frame, said position indicator providing an indication to an operator of said apparatus that the frame has been lowered to the fullest extent within said slot.

2. An apparatus according to claim 1, wherein the scraper comprises at least one adjustable spring loaded scraper blade to scrape the at least one gasket sealing surface of the stop log slot/guide, and wherein said flushing system uses at least one of water and compressed air to help remove said detached matter from the at least one stop log gasket sealing surface.

3. An apparatus for cleaning a stop log slot/guide, said stop log slot/guide having at least one gasket sealing surface thereon, comprising:

a frame removably positioned in a first position within the stop log slot/guide to cover said at least one gasket sealing surface; and a scraper, coupled to said frame and operable to scrape said at least one gasket sealing surface to detach attached matter therefrom when said frame is removed from said slot/guide.

4. An apparatus according to claim 1 further comprising at least one hydrolazer to strip attached matter from said at least one gasket sealing surface and flush it away from the gasket sealing surface as the frame is lowered into the slot/guide using a crane or similar lifting device.

5. An apparatus according to claim 3 further comprising at least one hydrolazer to strip attached matter from said at least one gasket sealing surface and flush it away from the at least one gasket sealing surface as the frame is removed from the slot/guide using a crane or similar lifting device.

6. An apparatus according to claim 1 further comprising at least one rotating brush operable to clean the at least one gasket sealing surface as the frame is lowered into the slot/guide.

7. An apparatus according to claim 3 further comprising at least one rotating brush operable to clean the at least one gasket sealing surface as the frame is removed from the slot/guide.

8. An apparatus according to claim 1, wherein said frame is lowered into said slot/guide using a using a crane or similar lifting device.

9. An apparatus according to claim 3, wherein said frame is removed from said slot/guide using a using a crane or similar lifting device.

* * * * *